United States Patent [19]

Rakov et al.

[11] Patent Number: 4,942,427

[45] Date of Patent: Jul. 17, 1990

[54] METHOD AND APPARATUS FOR ANNOTATING ELECTROPHOTOGRAPHIC PRINTS OF PHOTOGRAPHIC NEGATIVES

[75] Inventors: David M. Rakov; Joseph A. Manico, both of Rochester, N.Y.

[73] Assignee: Eastman Kodak Company, Rochester, N.Y.

[21] Appl. No.: 390,948

[22] Filed: Aug. 9, 1989

[51] Int. Cl.[5] ..... G03G 15/01

[52] U.S. Cl. ..... 355/202; 355/38; 355/39; 355/41; 355/327

[58] Field of Search ..... 355/202, 244, 326–328, 355/38–41, 68, 69; 364/518, 525; 352/90

[56] References Cited

U.S. PATENT DOCUMENTS

| | | | |
|---|---|---|---|
| 4,025,186 | 5/1977 | Hunt et al. | 355/212 |
| 4,099,860 | 7/1978 | Connin | 355/314 |
| 4,268,164 | 5/1981 | Yajima et al. | 355/41 |
| 4,294,536 | 10/1981 | Paxton | 355/311 |
| 4,551,008 | 11/1985 | Banton | 355/202 |
| 4,752,806 | 6/1988 | Haas et al. | 355/202 |
| 4,774,546 | 9/1988 | Corona et al. | 355/244 |

FOREIGN PATENT DOCUMENTS 59-170864 9/1984 Japan .

*Primary Examiner*—Joan H. Pendegrass
*Attorney, Agent, or Firm*—Raymond L. Owens

[57] ABSTRACT

A second exposure device is used to annotate color images produced by an electrophotographic printer. The exposure level and position of the annotation are chosen based on the color density content of the image.

6 Claims, 1 Drawing Sheet

METHOD AND APPARATUS FOR ANNOTATING ELECTROPHOTOGRAPHIC PRINTS OF PHOTOGRAPHIC NEGATIVES

BACKGROUND OF THE INVENTION

1. Field of the Invention

This invention relates to method and apparatus for annotating electrophotographic prints of photographic negatives using exposure by a second light source.

2. Background Art

When used here, the term annotation means any modification of the pictorial image, such as adding a title, frame numbers, or a decorative design; removing part of the image; changing the color or contrast of part of the image; or the like. Several ways have been proposed for annotating electrophotographic prints.

In U.S. Pat. No. 4,774,546, an annotation device includes an illumination source, an addressable light modulation device, and a lens array for forming the modulated light pattern on the photosensitive surface.

In U.S. Pat. No. 4,551,008, an apparatus uses flexible fingers with reflective surfaces to reflect light in order to discharge a photoconductor in an imagewise pattern.

In U.S. Pat. No. 4,752,806, a multi-mode document imaging system capable of copying a document includes an optical system to project light to add another image to the print.

None of these references disclose means for annotation that choose the position, color, or density of the annotation in response to the content of the pictorial image.

In U.S. Pat. No. 4,268,164, an electrophotographic apparatus copies and annotates documents. The apparatus includes a copy board on which the document to be copied is placed and slidable position indicating means along the edge of the copy board that can be adjusted to indicate where the annotation should be placed relative to the image of the document. This, however, is a manually operated apparatus in which an operator must position the indicating means. Also, the system requires that the first image end or be masked off in the region where the second image or annotation is to be placed. It does not provide for superimposing the annotation on the image of the document.

SUMMARY OF THE INVENTION

An object of this invention is to provide aesthetically pleasing annotated color photographic prints made using an electrophotographic process.

A further object is to select the position, color, and density of the annotation so as to produce an aesthetically pleasing print.

These objects are achieved by apparatus for annotating a color print of a photographic negative made by an electrophotographic printer having a photoconductor, comprising: (a) means for scanning a negative to acquire density information relating to density of different colors at positions within the negative; (b) means for projecting light through the negative onto the photoconductor to form color separation electrostatic images on the photoconductor; (c) second exposure means for projecting light onto the photoconductor selectively to discharge the color separation images to annotate the image; and (d) logic and control means for controlling the second exposure means to effect the annotation in accordance with density information measured by the scanning means.

According to the invention, annotation is accomplished by a second exposure device located between an exposure station and a toning station of an electrophotographic printer. The second exposure device can consist of an LED array, a laser diode array, a light source modulated by a liquid crystal array or a light valve array, or any other electronically addressable light source for selectively discharging the photoconductor to create the desired annotation. The second exposure device is used to write directly on the separation images representing the pictorial image. By selectively illuminating the color separation images the color of the annotation can be controlled.

According to this invention, information gathered by the scanner would be used automatically by the printer to choose the position, density, and color of the annotation to produce a pleasing result. For instance, to make a title easy to read, an area of the picture containing fairly uniform density and color would be chosen. The density and color of the annotation would be chosen to contrast with the background in the chosen area. This makes it possible to add titles and other such annotation without masking off the area containing the annotation.

DESCRIPTION OF THE INVENTION

Figure 1:
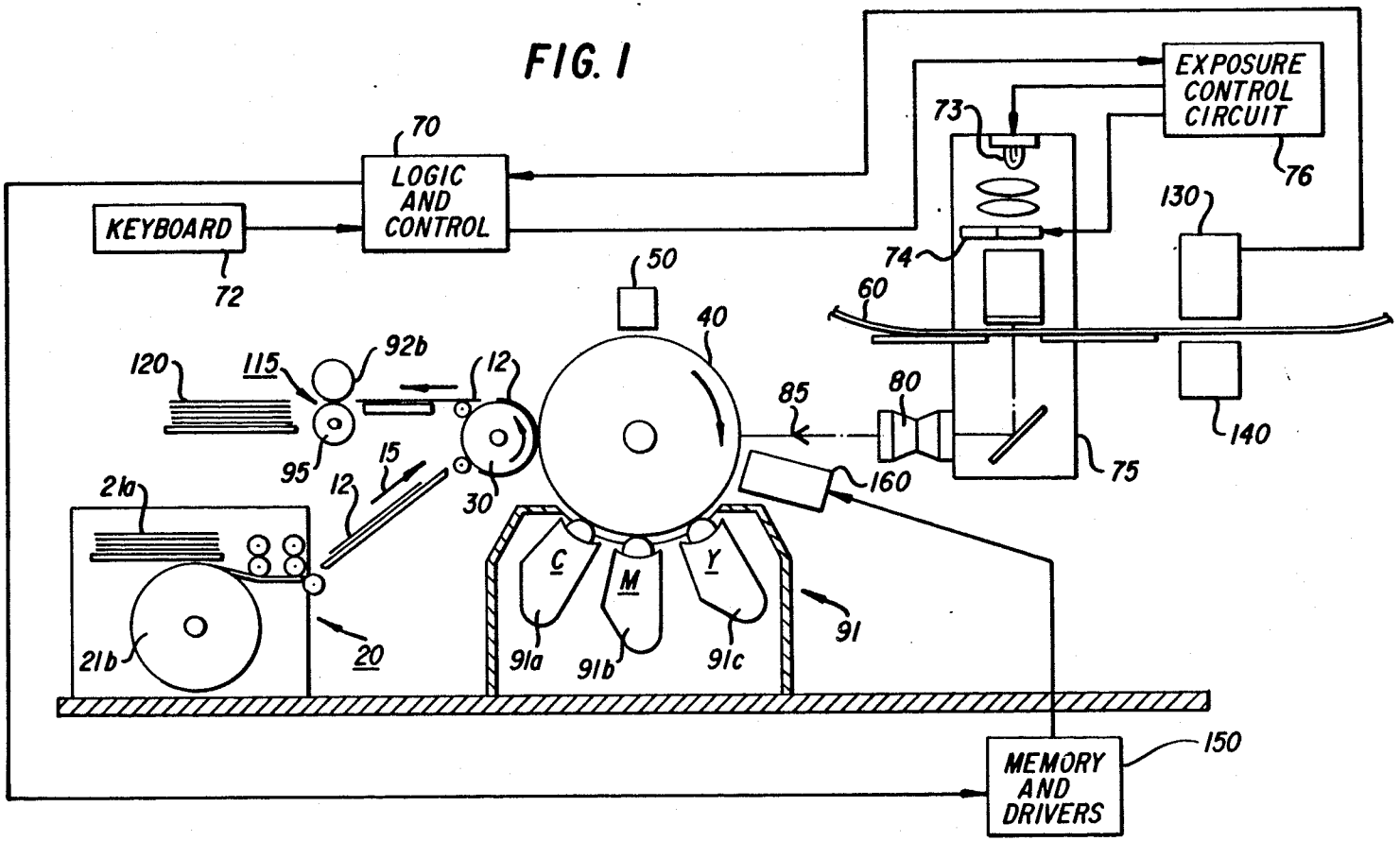
FIG. 1 is a schematic in accordance with the invention of an electrophotographic apparatus for producing prints of photographic negatives.

The present invention is adapted to be used in electrophotographic apparatus such as that shown and described in commonly-assigned U.S. Pat. No. 4,025,186 issued May 24, 1977. As disclosed therein, a photoconductive member is moved past a series of stations. At the start of the copy cycle, the photoconductive member receives an electrostatic charge at a charging station. A light image of a negative is then projected onto the charged photoconductive member at an exposure station to form a latent electrostatic image. The electrostatic image is developed with toner at a toning station. A receiver is brought into contact with the photoconductive member at a transfer station where the toner image is transferred to the receiver. The receiver carrying the unfused toner image is separated from the photoconductive member and passed through a fusing station comprised of two rollers which permanently fuse the toner to the receiver, forming a finished print.

With reference to FIG. 1, the photoconductive member 40, shown as a rotatable drum, receives a substantially uniform electrostatic charge from the charging station 50. Cyan, magenta, and yellow color separation images of a frame of a photographic negative 60 are sequentially exposed by a flash lamp 73 in a housing 75. The colors are selected by rotating the filter wheel 74, which contains red, green, and blue filters. The flash lamp 73 and filter wheel 74 are actuated by exposure control circuit 76, which is controlled by logic and control unit 70. Logic and control systems for electrophotographic printers are well known in the art and include microprocessors. See for example U.S. Pat. Nos. 4,099,860 and 4,294,536.

Before reaching the lamp house 75, each negative frame passes a scanner 130. The negative is illuminated by the lamp 140 and the red, green, and blue color densities of the negative are measured as a function of position within the frame. The pattern of measurements forms a rectangular grid covering the negative frame. The color density data are sent to the logic and control unit 70 where they are processed. The logic and control unit 70 uses these data to determine the exposure conditions to use when printing that frame to produce the proper density and color balance. According to the present invention, the logic and control unit 70 also uses these data to determine any or all of the conditions for printing the annotation, such as the position, the density, and the color of the annotation.

A colored light image of the negative 60 passes through a lens 80 and is directed in direction 85 onto the photoconductive member 40. Where light strikes it, the photoconductive member 40 is discharged, forming an electrostatic image of the negative. After this exposure, the photoconductive member 40 rotates so that the image passes under an a second exposure device 160. The second exposure device 160 selectively discharges the photoconductive member 40, thereby annotating the previously created electrostatic image. Instructions specifying the annotation are provided by the operator to the logic and control unit 70 through a keyboard 72. The logic and control unit 70 uses the instructions from the operator in conjunction with the information from the scanner 130 to control the second exposure device 160. Data and control signals are sent from the logic and control unit 70 to a memory and drivers unit 150. The memory and drivers unit 150 contains a memory that stores the information to be written by the second exposure device 160 and drivers that control the writing elements in the second exposure device 160, according to the information stored in the memory.

The photoconductive member 40 continues rotating so that the cyan, magenta, and yellow electrostatic latent images are sequentially developed with toner from toner station 91 comprised of cyan toner station 91*a*, magenta toner station 91*b*, and yellow toner station 91*c*. The developed colored toner images are then sequentially transferred to a receiver 12 brought into contact with the photoconductive member 40 at the transfer station 30. The receiver 12 carrying the three unfused toner images is separated from the photoconductive member 40 and passed through a fusing station 90 to complete the production of the print.

The scanner includes a light source 140 and a unit 130 containing three linear arrays of 24 photodiodes, each oriented perpendicular to the motion of the film, and electronics associated with the diode arrays. Filters are used so that each array measures the density of one of the primary colors: red, green, or blue. The electronics include logarithmic amplifiers that convert the currents from the photodiodes to voltages that represent densities. The voltages that represent the densities are sent to the logic and control unit 70.

As is well understood in the art, each array typically samples each negative frame 36 times as the negative is moved through the scanner. This produces a rectangular array of $24 \times 36 = 864$ density measurements for each color in each frame. When used to scan standard 35 mm film negatives, this produces measurements 1 mm apart.

There are many types of scanners that can be used in accordance with the invention. They include scanners with linear and two dimensional arrays of detectors; photodiode, phototransistor, and CCD detectors; scanners with spinning disks with holes through which the light is transmitted, thereby effecting the scanning function (Nipkow disk systems); scanners that are separate from the exposure station (as described in the example above); and scanners that are part of the exposure station.

Photographic printers employ scanners that can be used in this invention. Such scanners read color densities as a function of position in the negative before printing in order to provide information to the printer control system that automatically chooses the exposure and color balance conditions for printing. One example is the KODAK Minilab System 50 Printer/Paper Processor. It contains a 3 color CCD scanner system. Another example is the KODAK CLAS 35 Color Printer. It contains a high-resolution color linear array scanner that reads 864 pixels per color in each negative frame.

The logic and control unit 70 includes a microcomputer that electronically controls the functioning of all the subsystems that make up the printer. It receives instructions from the operator through the keyboard 72. Part of the program that specifies the function of the logic and control unit 70 is the exposure determination algorithm. This algorithm uses the density information from the scanner to choose the printing conditions to produce the proper density and color balance in the print. This information is transmitted to the exposure control circuit 76, which controls the lamp 73 and the filters 74. There is also an algorithm that uses the same density information to choose the conditions for printing the annotation. This information is transmitted from the logic and control unit 70 to the memory and drivers unit 150.

EXAMPLE

The following is an example of how the apparatus of FIG. 1 can be used to print rolls of photographic film brought in by customers. In the printer, the photoconductor is initially given a uniform charge of +400 volts by a corona charger. Light is projected through a negative onto the charged film to create an electrostatic image. After exposure, the voltage on the film can range from 0 to 400 volts. The annotation is written by a second exposure device that selectively discharges the photoconductor in an imagewise, controlled fashion. Since in this example the printer makes positive prints from negative images on the film, the printer is set up for a negative process. In this example, the toner is positively charged and a positive bias voltage of +400 volts is applied to the developer station. Places on the film that reach the development station still bearing the initial charge of +400 volts will not receive any toner, since the film and the development station are at the same voltage. Places on the film with less than +400 volts will receive toner, with the amount of toner deposited increasing as the film voltage decreases.

Let us assume a roll of film containing negatives of pictures taken during a summer vacation is to be printed. The customer asks that the title "Colorado 1988" be printed near the bottom of each print. The title and the requested location are specified to the system through the keyboard 72. The first picture shows boats on a lake. There are several boats in the middle and far distance and one occupying the middle and left portions of the foreground. The right portion of the foreground (i.e. the right bottom of the picture) is smooth white sand. When the negative is scanned prior to exposure, the logic and control unit 70 determines that the lower middle and left portions of the picture contain varying densities and colors and that the lower right side of the picture is fairly uniform in density and color, that the area is light, and that the color is fairly neutral. The logic and control unit 70 uses the information from the scanner 140 in combination with the information specified through the keyboard 72 to determine the exact location, color, and density for the title that will produce the most aesthetically pleasing result. Because the scanner 140 detected varying colors and densities in the lower middle and left parts of the picture, the system chooses not to put the title there, since that is a part of the picture that contains an object that the customer may not want covered by the title and because the varying color and density may make the title hard to read. The system chooses to put the title in the lower right portion of the picture, where the manner 140 deteted less variation in color and density. The color and density of the title are chosen to contrast with the light neutral in the picture. Many different choices are possible. The particular choice would be determined by the algorithm used to control the system. For instance, the algorithm could choose black letters, since that would look pleasing and be easily readable against a light neutral background. Since the printer uses a negative process, black letters would be written by fully discharging all three color separations in the pattern of the title to be written. Another possibility would be to make the title red. This requires that the magenta and yellow separations be fully discharged in the pattern of the title, but not the cyan separation. Other hues can be achieved by varying the amounts of the exposures of the annotation on the color separation images, taking into account the amount the photoconductor has already been discharged by the exposure through the negative. A similar process would be followed for each subsequent negative frame to be printed.

The invention has been described in detail with particular reference to a preferred embodiment thereof, but it will be understood that variations and modifications can be effected within the spirit and scope of the invention.

We claim:

1. Apparatus for annotating a color print of a photographic negative made by an electrophotographic printer having a photoconductor, comprising:

(a) means for scanning a negative to acquire density information relating to densities of different colors at positions within the negative;

(b) first exposure responsive to such density information for projecting light through the negative onto the photoconductor to form color separation electrostatic images on the photoconductor;

(c) second exposure means for projecting light onto the photoconductor selectively discharging the color separation electrostatic images to annotate the image; and (d) logic and control means for controlling the second exposure means to effect the annotation in accordance with density information measured by the scanning means.

2. The apparatus of claim 1 wherein the logic and control means causes the second exposure means automatically to control the position and density of the annotation.

3. The apparatus of claim 1 includes an operator-controlled keyboard, the logic and control means being coupled to the keyboard for controlling the second exposure means to vary the position and density of the annotation.

4. The apparatus of claim 2 wherein said first light projecting means includes a flash lamp and color filters and wherein a negative is illuminated by light from the flash lamp passing through the color filters.

5. Apparatus for annotating an electrostatic color print of a photographic negative, comprising:

(a) an electrophotographic printer having a photoconductor and a development station for developing electrostatic color images;

(b) means for scanning a negative to acquire densities of different colors at positions within the negative;

(c) first exposure means responsive to such density information for projecting light through the negative onto the photoconductor at an exposure position to form cyan, magenta, and yellow color separation electrostatic images on the photoconductor;

(d) second exposure means disposed between the exposure position and the development station for projecting light onto the photoconductor for selectively discharging the color separation images to annotate the image; and (e) logic and control means for controlling the second exposure means in accordance with the density information measured by the scanning means.

6. A method of annotating a print of a photographic negative comprising:

(a) scanning a negative to measure color densities at different positions on the negative;

(b) using a first exposure means to project color separation light images of the negative onto a photoconductor to form three color separation electrostatic images of the negative representing the cyan, magenta, and yellow separation images;

(c) using a second exposure means to project light to modify at least some of the color electrostatic images by selectively discharging the color separation images on the photoconductor; and (d) using the density and position information to control the second exposure device and to control exposure level and position of the light exposure on the photoconductor to produce an annotation.

* * * * *